US010294697B2

(12) United States Patent
Sundberg et al.

(10) Patent No.: US 10,294,697 B2
(45) Date of Patent: May 21, 2019

(54) ACCESS-CONTROL SYSTEM FOR DOOR LOCK

(71) Applicant: Dorel Juvenile Group, Inc., Foxboro, MA (US)

(72) Inventors: Brian C Sundberg, Chester, NH (US); Laura Kay Raffi, Holliston, MA (US); Alice Mayfield, San Francisco, CA (US); Scott E Stropkay, Carlisle, MA (US); Mark Matthews, Scituate, MA (US); Evan Hutker, Cambridge, MA (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 460 days.

(21) Appl. No.: 15/040,512

(22) Filed: Feb. 10, 2016

(65) Prior Publication Data

US 2016/0230417 A1 Aug. 11, 2016

Related U.S. Application Data

(60) Provisional application No. 62/114,122, filed on Feb. 10, 2015.

(51) Int. Cl.
*E05B 63/00* (2006.01)
*E05B 1/00* (2006.01)
(Continued)

(52) U.S. Cl.
CPC ..... *E05B 63/0043* (2013.01); *E05B 1/0007* (2013.01); *E05B 37/20* (2013.01);
(Continued)

(58) Field of Classification Search
CPC ... Y10T 292/82; Y10T 292/85; Y10T 292/57; Y10T 292/03; Y10T 16/506; Y10T 292/34; Y10T 292/37; Y10T 70/7915; Y10T 16/46; Y10T 70/796; Y10T 70/554; Y10T 70/5562; Y10T 70/5788; Y10T 70/7983; E05B 1/0007; E05B 1/0061; Y10S 292/02; Y10S 16/30
(Continued)

(56) References Cited

U.S. PATENT DOCUMENTS 2,999,523 A * 9/1961 Amdur ..... E05B 1/0061 150/155
3,343,387 A * 9/1967 Cochran ..... E05B 13/001 70/424
(Continued)

FOREIGN PATENT DOCUMENTS

CN 101985864 A 3/2011
CN 203499363 U 3/2014
EP 0301143 A1 2/1989

OTHER PUBLICATIONS

PCT International Search Report and Written Opinion completed on Mar. 23, 2016 and issued in connection with PCT/US2016/017355.
(Continued)

*Primary Examiner* — Mark A Williams
(74) *Attorney, Agent, or Firm* — Barnes & Thornburg LLP

(57) ABSTRACT

An access-control system is provided for a door lock that is associated with a door and a rotatable doorknob. The access-control system includes a doorknob cover.

21 Claims, 8 Drawing Sheets

(51) Int. Cl.

| | |
|---|---|
| ***E05B 37/20*** | (2006.01) |
| ***E05B 67/00*** | (2006.01) |
| ***E05B 67/22*** | (2006.01) |
| ***E05C 19/18*** | (2006.01) |
| ***E05C 7/00*** | (2006.01) |
| *E05B 53/00* | (2006.01) |

(52) U.S. Cl.
CPC ..... *E05B 67/003* (2013.01); *E05B 67/22* (2013.01); *E05C 7/00* (2013.01); *E05C 19/18* (2013.01); *E05B 1/0015* (2013.01); *E05B 53/003* (2013.01)

(58) Field of Classification Search
USPC ..... 292/347, 348, 351
See application file for complete search history.

(56) References Cited

U.S. PATENT DOCUMENTS

| | | | | | |
|---|---|---|---|---|---|
| 4,082,351 | A * | 4/1978 | Chrones | E05B 13/001 | 16/414 |
| 4,570,470 | A | 2/1986 | Gray, Sr. | | |
| 4,629,229 | A * | 12/1986 | Correnti | E05C 19/18 | 292/246 |
| 4,869,086 | A | 9/1989 | Richards | | |
| 4,981,314 | A * | 1/1991 | Carr | E05B 1/0007 | 292/347 |
| 5,337,459 | A | 8/1994 | Hogan | | |
| 5,423,583 | A * | 6/1995 | Crockom | E05B 17/142 | 292/1 |
| 5,425,256 | A * | 6/1995 | Crosby | E05B 13/001 | 292/DIG. 2 |
| 5,485,733 | A | 1/1996 | Hoffman | | |
| 5,713,615 | A * | 2/1998 | Tsai | E05B 1/0061 | 292/347 |
| 6,324,879 | B1 * | 12/2001 | Kennedy | E05B 13/001 | 70/416 |
| 8,282,140 | B1 | 10/2012 | Joy | | |
| 2006/0202484 | A1 * | 9/2006 | Lignell | E05B 13/001 | 292/1 |
| 2009/0126431 | A1 | 5/2009 | Zheng | | |
| 2009/0229323 | A1 * | 9/2009 | Dykstra | E05B 13/001 | 70/158 |
| 2009/0250948 | A1 * | 10/2009 | Forrest | E05B 1/0015 | 292/251.5 |
| 2013/0025510 | A1 | 1/2013 | White | | |

OTHER PUBLICATIONS

PCT International Search Report and Written Opinion completed by the ISA/US dated Mar. 23, 2016 and issued in connection with PCT/US2016/017355.
PCT International Search Report and Written Opinion completed by the ISA/US dated Mar. 23, 2016 and issued in connection with PCT/US2016/017357.
PCT International Preliminary Report on Patentability dated Aug. 15, 2017 in connection with PCT/US2016/017357.
PCT International Preliminary Report on Patentability dated Aug. 15, 2017 in connection with PCT/US2016/017355.
Chinese Office Action corresponding to 201680014562.9 dated Oct. 15, 2018.

* cited by examiner

ACCESS-CONTROL SYSTEM FOR DOOR LOCK

PRIORITY CLAIM

This application claims priority under 35 U.S.C. § 119(e) to U.S. Provisional Application No. 62/114,122, filed Feb. 10, 2015, which is expressly incorporated by reference herein.

BACKGROUND

The present disclosure relates to doorknobs, and in particular, to an access-control system for a doorknob. More particularly, the present disclosure relates to a security system that can be mounted on a doorknob and operated to enable or disable functional operation of the doorknob.

SUMMARY

An access-control system is provided for a door lock that is associated with a door and a rotatable doorknob. The access-control system includes a doorknob cover.

A doorknob security system includes a doorknob cover that is adapted to be coupled to a doorknob that is associated with a door for movement relative to the doorknob. In illustrative embodiments, the doorknob security system further includes a non-operative movable DECOY lock-actuator button that is supported in a visible position adjacent to the doorknob cover for movement relative to the doorknob cover between a normal projected position and a temporary depressed position without activating an operative lock actuator that is linked to a door lock. The door lock is associated with the doorknob and cannot be unlocked regardless of how many times an unauthorized child or other unknowing child pushes the non-operative movable DECOY lock-actuator button.

In illustrative embodiments, the doorknob is supported on a knob-support spindle for rotation about an axis to control movement of a movable door latch relative to a door from (1) an extended position arranged to project into a latch receptacle formed in a companion door frame so that movement of the door relative to the companion door frame is blocked to retain the door in a closed position to (2) a retracted position withdrawn from the latch receptacle so that the door is free to be moved relative to the door frame to an opened position. The door latch does not move relative to the door from the extended position to the retracted position when the movable DECOY lock-actuator button is pushed.

In illustrative embodiments, the movable door latch cooperates with a latch-motion blocker to provide a door lock that is associated with the door but is not connected to the non-operative movable DECOY lock-actuator button. Instead, the latch-motion blocker is coupled to an operative lock actuator that is coupled to the rotatable doorknob and is separated from the non-operative movable DECOY lock-actuator button. As long as the door lock is unlocked, a user can rotate the doorknob about an axis of rotation to retract the door latch so that it disengages the companion door frame and the door can be opened. However, the operative lock actuator is normally hidden from view in accordance with the present disclosure so the only actuator-like component that is seen by an observer is a non-operative movable DECOY lock-actuator button that has the appearance of being real but, in fact, is non-functional and cannot be operated to lock or unlock the door lock.

In illustrative embodiments, the doorknob security system is mounted on a doorknob in accordance with the present disclosure to conceal the operative lock actuator and provide a non-operative visible and movable DECOY look-actuator button that will be seen by children. The DECOY lock-actuator button can be moved relative to a companion doorknob cover when pushed to provide the illusion of a functional lock actuator. However, the DECOY lock-actuator button is not connected to a door lock associated with the doorknob and therefore cannot be operated to unlock the door lock.

In illustrative embodiments, a doorknob security system comprises an actuator access-control shield that is mounted on a doorknob cover in accordance with the present disclosure to cover an aperture formed in a top wall of the doorknob cover to conceal an operative lock actuator located in an interior region bounded by the doorknob cover. The actuator access-control shield includes a non-operative movable DECOY lock-actuator button that lies in a prominent position above the doorknob cover so that is visible and will be seen by any children that try unlock a locked doorknob. The DECOY lock-actuator button is mounted for movement on a movable button support that is also included in the actuator access-control shield and is normally mounted for movement on the doorknob cover between an actuator-hiding position and an actuator-accessing position. Unknowing children can see and push the non-operative movable DECOY lock-actuator button included in the actuator access-control shield repeatedly without moving the hidden operative lock actuator that must be operated to unlock the door lock.

In illustrative embodiments, knowing caregivers can move the movable button support of the actuator access-control shield away from the doorknob cover from the actuator-hiding position to the actuator-accessing position to separate the DECOY lock-actuator button from the doorknob cover and open a lock actuator access aperture formed in the doorknob cover so as to expose the operative lock actuator that is coupled to the doorknob. Once exposed to view, the operative lock actuator can be gripped, touched, or otherwise activated by a person reaching through the now-opened lock actuator access aperture and then operated relative to the doorknob to unlock the door lock.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
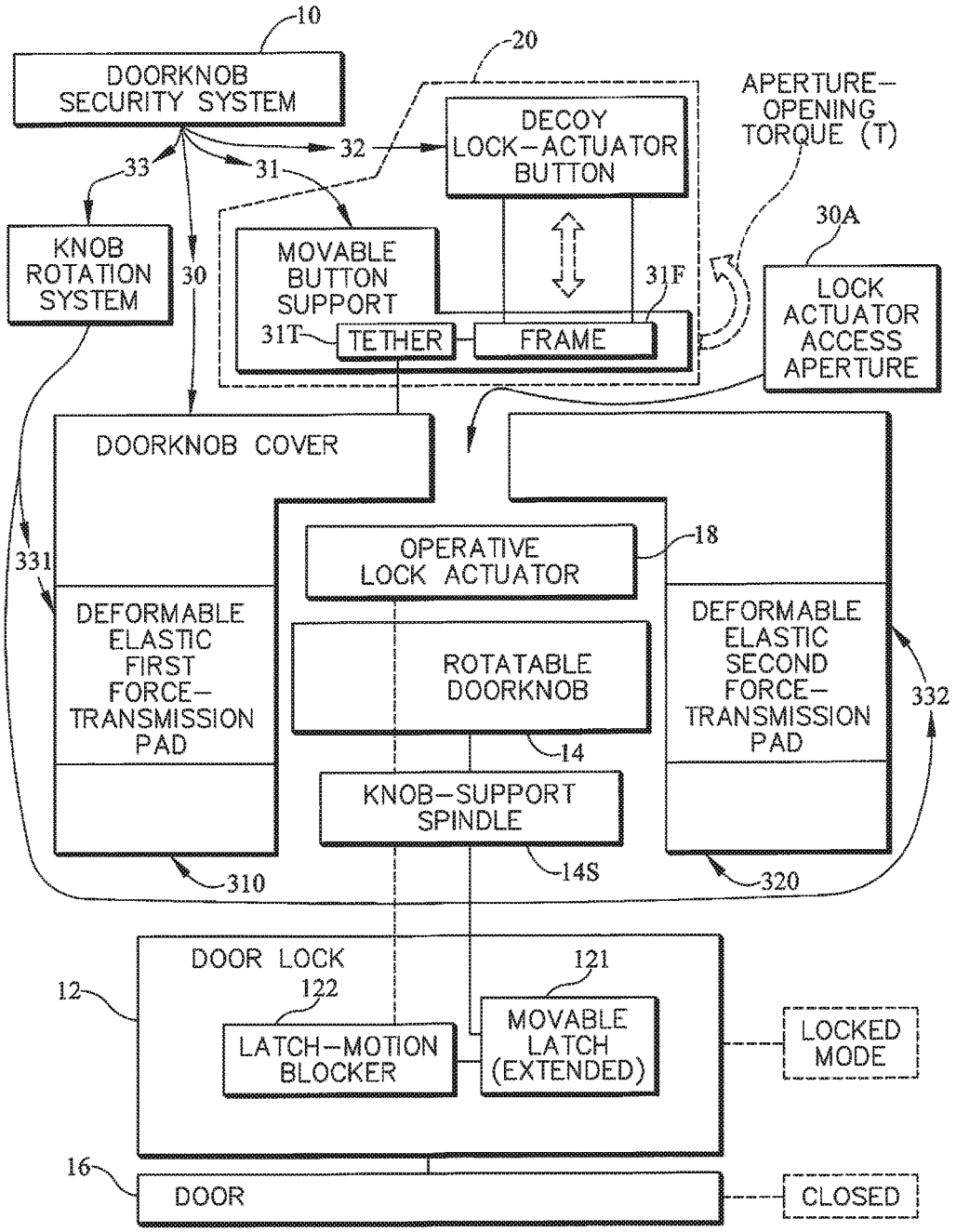
FIG. 1 is a diagrammatic view of a doorknob security system in accordance with the present disclosure that is adapted to be mounted on a doorknob that is associated with (1) a door, (2) a door lock, and (3) an operative lock actuator associated with the doorknob and door lock, and suggesting that the doorknob security system includes a relatively rigid doorknob cover formed to include a lock actuator access opening, a movable button support mounted for selective movement relative to the doorknob cover between an aperture-closing position suggested in FIG. 1 and an aperture-opening position suggested in FIG. 3 and arranged to cooperate with the doorknob cover normally to conceal the operative lock actuator from view when placed in the aperture-closing position, a DECOY lock-actuator button mounted in a visible position for movement on the movable button support and arranged to cooperate with the movable button support to define an actuator access-control shield, and a knob rotation system comprising deformable elastic first and second force-transmission pads coupled to the relatively rigid doorknob cover to cover pad-receiver apertures formed in a side wall of the doorknob cover and further suggesting that the door lock includes (1) a movable latch that can be extended and retracted relative to the door in response to rotation of the rotatable doorknob and a knob-support spindle coupled to the rotatable doorknob and a (2) latch-motion blocker that is included in the door lock and can be actuated as suggested in FIG. 3 by manipulation of the operative lock actuator coupled to the rotatable doorknob to engage the movable latch to lock the door lock or to disengage the movable latch to unlock the door lock once the movable button support is moved relative to the doorknob cover to open the lock actuator access aperture formed in the doorknob cover and expose the operative lock actuator to view.
Figure 5:
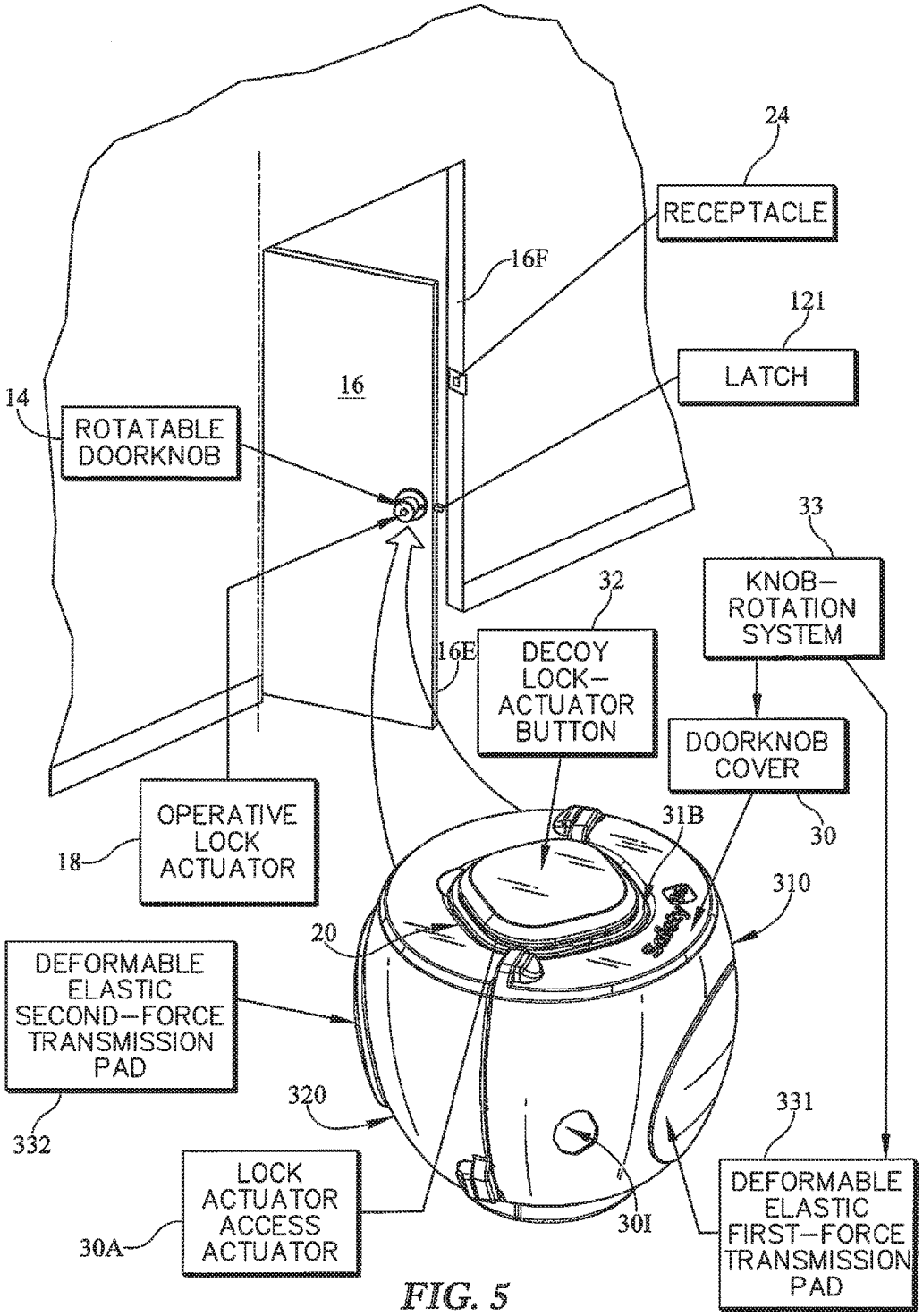
FIG. 5 shows an enlarged illustrative doorknob security system in accordance with the present disclosure that is sized to be mounted on a rotatable doorknob that is associated with a door that is pivotable relative to a door frame formed to include a passageway about a vertical axis between opened and closed positions and also shows that the doorknob security system includes a relatively rigid doorknob cover, opposing round deformable elastic first and second force-transmission pads coupled to side walls of the doorknob cover, and an actuator access-control shield that is mounted on a top wall of a doorknob cover and is configured to include a movable button support that is arranged to close a lock actuator access aperture formed in a top wall of the doorknob (see FIGS. 7 and 8) and a visible DECOY lock actuator button mounted on the movable support button for movement therewith and movement relative thereto.

A doorknob security system 10 is configured to provide security for a door lock 12 associated with a companion rotatable doorknob 14 and a door 16 as suggested in FIGS. 1 and 5. Doorknob security system 10 is adapted to be mounted on rotatable doorknob 14 to hide a real operative lock actuator 18 that is used to lock and unlock door lock 12 and is mounted on doorknob 14 and is coupled to door lock 12 as suggested diagrammatically in FIG. 1. Doorknob security system 10 includes a movable DECOY lock-actuator button 32 that is visible to a person that wishes to unlock door lock 12, has the appearance of a real door-lock actuator, and yet is separate from the hidden real operative lock actuator 18.

DECOY lock-actuator button 32 is non-functional and cannot be operated by a child or an adult to unlock the door lock 12 associated with rotatable doorknob 14. As suggested in FIG. 2, an unknowing child could apply a false actuation force (F) to DECOY lock-actuator button 32 and cause DECOY lock-actuator button 32 to move relative to rotatable doorknob 14 from a normal projected position suggested in FIGS. 1 and 7 to a temporary depressed position suggested in FIG. 2 without activating the hidden operative lock actuator 18 to unlock door lock 12. Even though the movable DECOY lock-actuator button 32 is pushed repeatedly, door lock 12 will remain locked.

Figure 2:
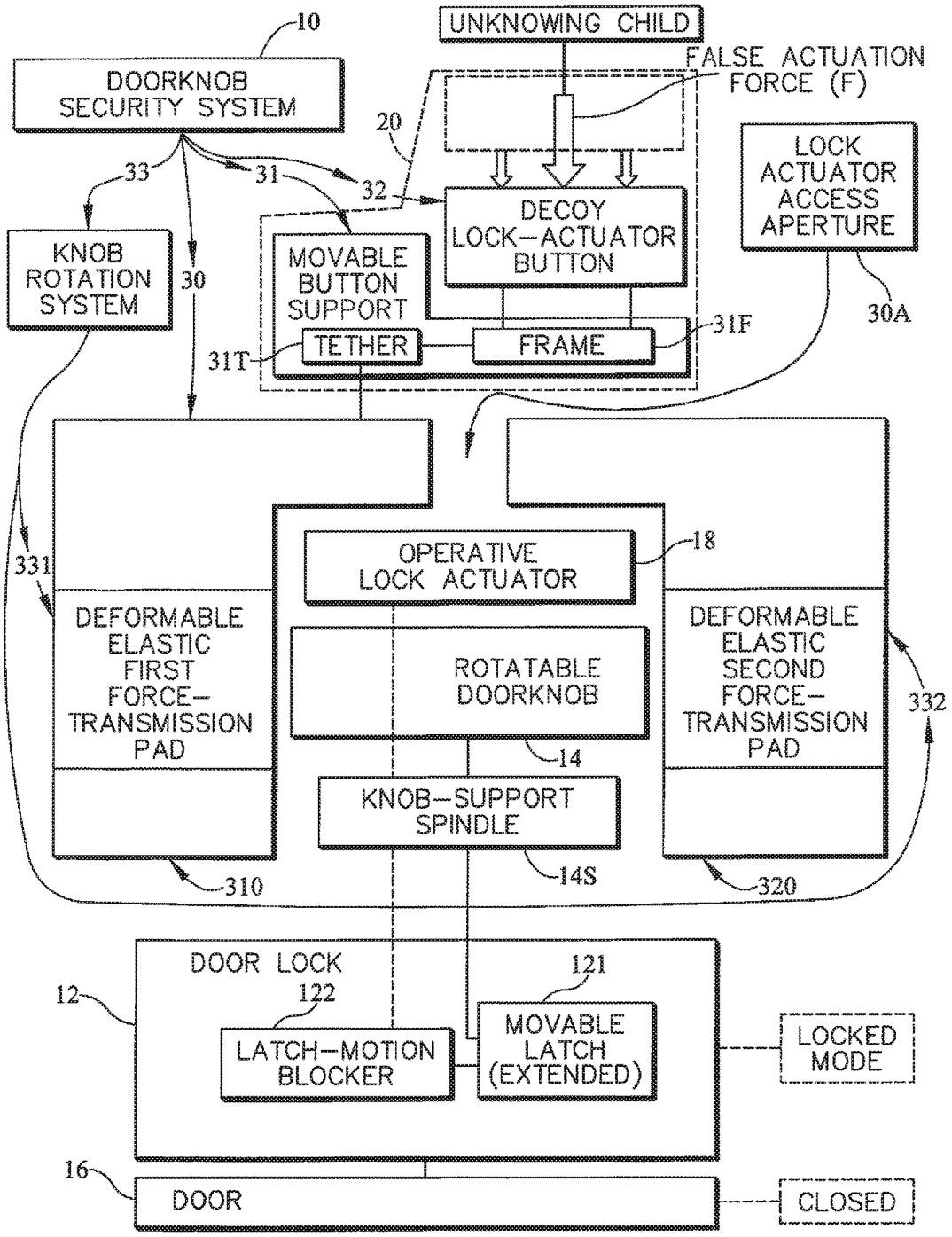
FIG. 2 is a view similar to FIG. 1 showing that an unknowing child has pushed downwardly on the visible DECOY lock-actuator button to move that button relative to a frame included in the movable button support and relative to the doorknob cover without causing movement of the concealed operative lock actuator so that the latch-motion blocker remains engaged to the movable latch and door lock remains locked.
Figure 7:
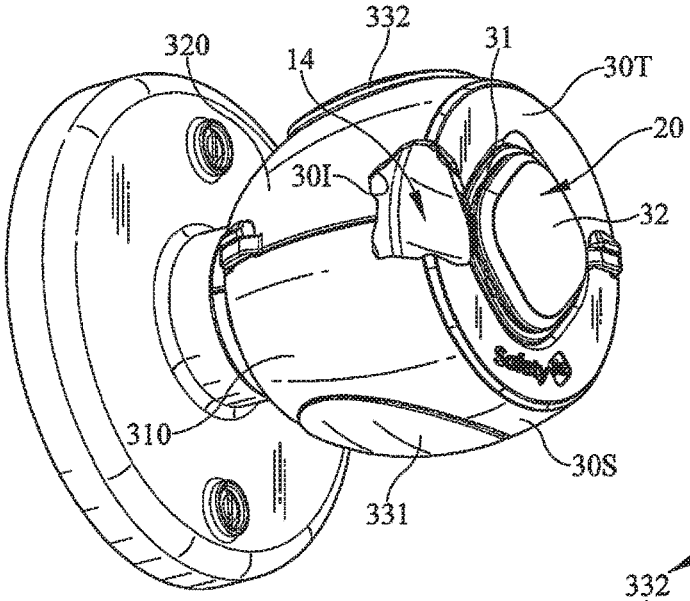
FIG. 7 is a perspective view of the illustrative doorknob security system after it has been assembled and mounted on a rotatable doorknob, with a portion of the doorknob cover broken away to reveal the underlying doorknob, and showing that the movable button support of the actuator access-control shield is arranged to lie in an aperture-closing position on the doorknob cover to close the lock actuator access aperture and conceal the underlying operative lock actuator from view and to present the non-operative movable DECOY lock-actuator button in a visible position on the top wall of the doorknob cover.

Operative lock actuator 18 is linked to door lock 12 and is normally hidden from view as suggested diagrammatically in FIGS. 1 and 2 and illustratively in FIG. 7. Operative lock actuator 18 can only be accessed and operated after a knowing person has moved an actuator access-control shield 20 including DECOY lock-actuator button 32 in accordance with the present disclosure relative to rotatable doorknob 14 as suggested diagrammatically in FIG. 3 and illustratively in FIG. 8 to reveal the previously hidden operative lock actuator 18. Once the operative lock actuator 18 is visible and accessible, a knowing person can apply an effective actuation motion (M) to the operative lock actuator 18 to unlock door lock 12 as suggested in FIG. 3.

Figure 8:
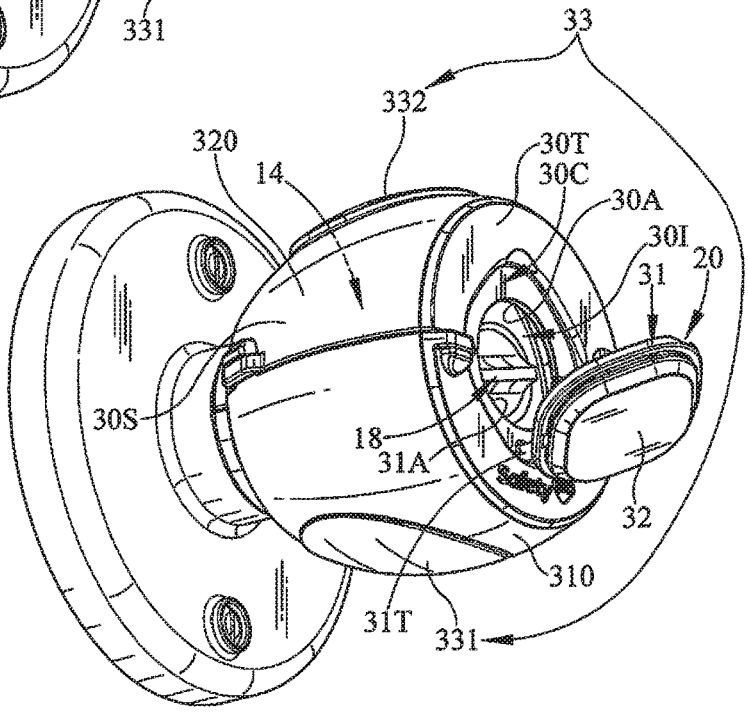
FIG. 8 is a perspective view similar to FIG. 7 showing that the movable button support of the actuator access-control shield has been separated from the doorknob cover by a knowing person to open the lock actuator access aperture and expose the formerly concealed operative lock actuator so that it can be gripped and moved by the knowing person to lock or unlock a door lock associated with the rotatable doorknob.
Figure 9:
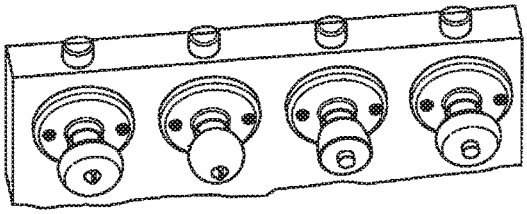
FIG. 9 is a series of illustrative doorknobs suitable for use with the child-resistant, access-control unit of the present disclosure.
Figure 10:
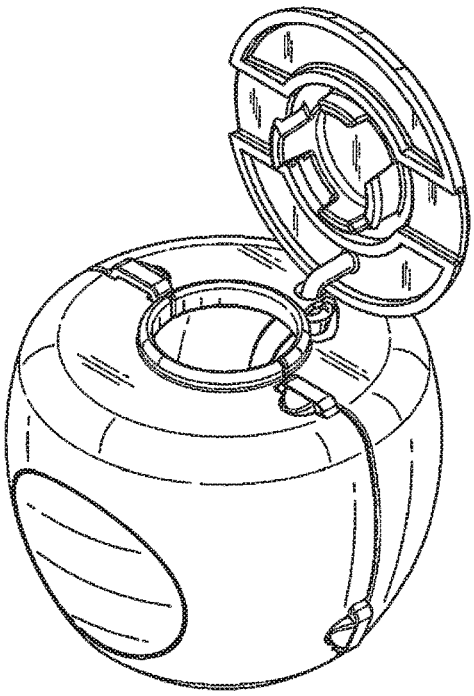
FIGS. 10-12 show alternative illustrative embodiments of doorknobs security systems in accordance with the present disclosure.
Figure 11:
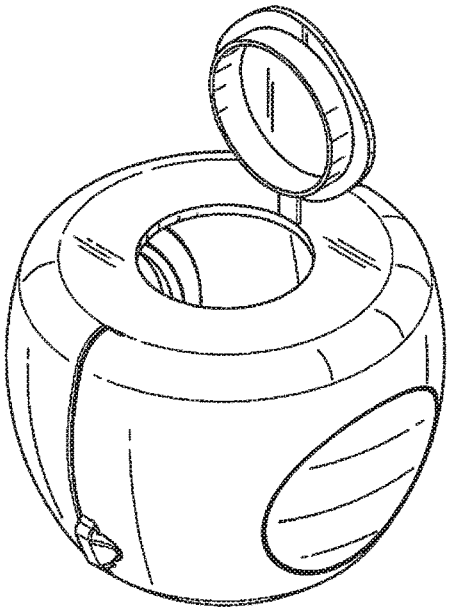
Figure 12:
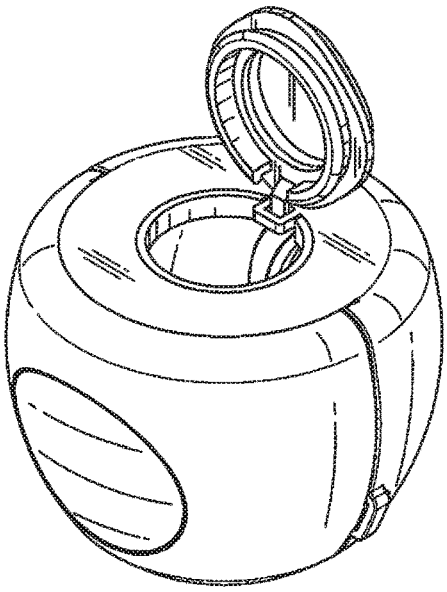

In illustrative embodiments, doorknob security system 10 also includes a doorknob cover 30 that is adapted to be coupled to a doorknob 14 as suggested diagrammatically in FIGS. 1-4 and illustratively in FIGS. 7 and 8 for movement relative to doorknob 14. Doorknob cover 30 is mounted loosely on doorknob 14 so that it can spin relatively freely about an axis of rotation 14A associated with the rotatable doorknob 14 under normal circumstances without causing rotation of doorknob 14 about rotation axis 14A.

Doorknob security system 10 also includes a knob rotation system 33 that is coupled to doorknob cover 30 as suggested diagrammatically in FIGS. 1-4 and illustratively in FIGS. 7 and 8. In illustrative embodiments, knob rotation system 33 includes opposing deformable elastic first and second force-transmission pads 331, 332 that are mounted on doorknob cover 30 and configured to change from a normally undeformed shape as suggested diagrammatically in FIGS. 1-3 and illustratively in FIGS. 5-8 to a torque-transmitting deformed shape as suggested diagrammatically in FIG. 4. As suggested in FIG. 4, once door lock 12 is unlocked by a knowing person that has accessed and manipulated the operative lock actuator 18 as suggested in FIG. 3, the knowing person can apply a manual squeeze force to the opposing deformable elastic first and second force-transmission pads 331, 332 to cause the pads 331, 332 to move relative to deformable cover to assume their torque-transmitting deformed shapes so that the knowing person is able to grip rotatable doorknob 14 tightly and then apply a knob-rotation torque to the rotatable doorknob 14 that is sufficient to retract a movable door latch 121 included in the door lock 12 from a companion latch receptacle 24 formed in a door frame 16P associated with door 16 to free the door 16 to be swung by the knowing person to an opened position as suggested in FIG. 5

Doorknob 14 is mounted for rotation about rotation axis 14A on a knob-support spindle 22 that is coupled to a movable latch 121 that is included in door lock 12 as suggested diagrammatically in FIG. 1. Movable latch 121 is spring-loaded normally to extend beyond an edge 16E of door 16 as suggested in FIG. 5 so that latch 121 extends into a companion latch receptacle 24 coupled to a frame 16F associated with door 16 to retain door 16 in a closed position. Door lock 12 also includes a latch-motion blocker 122 that can be engaged to movable latch 121 as suggested in FIGS. 1 and 2 to the block retraction of latch 121 from latch receptacle 24. When door lock 12 is locked, a user cannot rotate rotatable doorknob 14 about rotation axis 14A to cause knob-support spindle 22 to retract the spring-loaded latch 121 to exit and disengage the companion latch receptacle 24 so that the door 16 is free to be opened.

In illustrative embodiments, doorknob security system 10 includes a doorknob cover 30, a movable button support 31, and a DECOY lock-actuator button 32 as suggested in FIG. 1. Doorknob cover 30 is arranged to cover a portion of doorknob 14 to hide the operative lock actuator 18 that is coupled to doorknob 14 so that it cannot be seen or noticed by young unknowing children. The DECOY lock-actuator button 32 is mounted on the movable button support 31 to provide an actuator access-control shield 20 that is arranged normally to close a lock actuator access aperture 30A formed in a top wall of doorknob cover 30.

The DECOY lock-actuator button 32 is arranged to lie normally in an unconcealed visible position to block access to the operative lock actuator 18 that is hidden from view in interior region 301 of doorknob cover 30 as suggested diagrammatically in FIG. 1 and illustratively in FIG. 7. A young child attempting to play with or unlock the door lock 12 will see only the visible non-operative movable DECOY lock-actuator button 32 that is carried on the movable button support 31 that is coupled to the doorknob cover 30 that covers the doorknob 14 as suggested in FIGS. 1 and 7. That young child will try to push the DECOY lock-actuator button 32 to try to unlock the door lock 12 as suggested in FIG. 2. However, movement of the visible DECOY lock-actuator button 32 relative to the doorknob cover 30 from the normal projected position suggested in FIG. 1 to the temporary depressed position suggested in FIG. 2 by an unknowing child or other person does not cause the concealed operative lock actuator 18 to move to unlock the door lock 12 so that the door lock 12 remains in the locked mode and the door 16 is retained in its closed position as also suggested in FIG. 2.

Doorknob cover 30 includes a top wall 30T and a side wall 30S that is arranged to extend downwardly from a perimeter edge of top wall 30T as suggested diagrammatically in FIG. 1 and illustratively in FIGS. 7 and 8. Top wall 30T is formed to include a lock actuator access aperture 30A that opens into an interior region 301 bounded by doorknob cover 30 and sized to contain the doorknob 14 and the operative lock actuator 18 that is coupled to doorknob 14 as suggested in FIG. 8.

Figures 6, 6A, 6B:
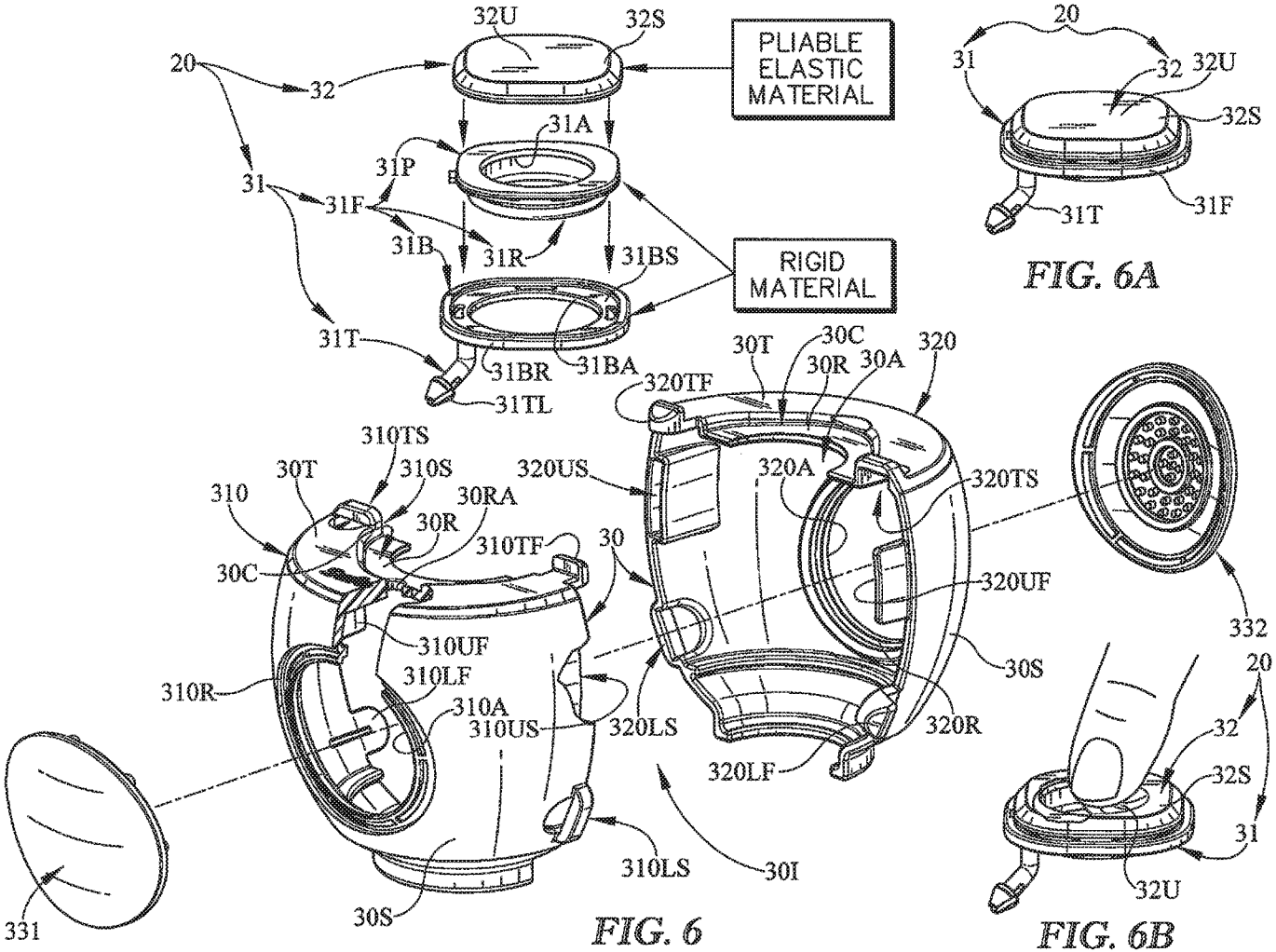
FIG. 6 is an exploded perspective assembly view of the doorknob security system of FIG. 5 showing that the relatively rigid doorknob cover comprises a first shell formed to include a first pad-receiver aperture and a companion second shell formed to include a second pad-receiver aperture and configured to mate with the first shell to define an interior knob-receiving region therebetween, and showing that the doorknob security system also includes a knob rotation system comprising a deformable elastic first force-transmission pad adapted to be coupled to the first shell to cover the first pad-receiver aperture and a deformable elastic second force-transmission pad adapted to be coupled to the second shell to cover the second pad-receiver aperture, and suggesting that the movable button support includes a frame sized to mate with an upwardly facing frame-support rim defined by the first and second shells and a frame tether having an upper end coupled to the frame and an opposite lower end adapted to be coupled to the first shell to limit movement of the frame relative to the first shell, and suggesting that the non-operative movable DECOY lock-actuator button is mounted in a visible position for relative movement on the frame.
FIG. 6A is a perspective view of the DECOY lock-actuator button shown in FIG. 6 after it has been mounted on the movable button support shown in FIG. 6 to produce an actuator access-control shield and showing the button in an illustrative normal projected position.
FIG. 6B is a view similar to the view shown in FIG. 6A showing the DECOY lock-actuator button in an illustrative temporary depressed position.

Actuator access-control shield 20 includes a movable button support 31 coupled to doorknob cover 30 and a DECOY lock-actuator button 122 mounted on movable button support 31 for movement relative to movable button support 31 as suggested diagrammatically in FIG. 1. and illustratively in FIGS. 6-8. Movable button support 31 includes a frame 31F configured to mate with top wall 30T of doorknob cover 30 upon movement of actuator access-control shield 20 relative to doorknob cover 30 to assume the aperture-closing position. Movable button support 31 also includes a tether 31T coupled to top wall 30T and frame 31F to limit movement of movable button support 31 relative to doorknob cover 30 when frame 31F is unmated from top wall 30T to open lock actuator access aperture 30A to expose the operative lock actuator 18.

To gain access to operative lock actuator 18, a knowing person can move actuator access-control shield 20 from the aperture-closing position shown in FIG. 7 wherein the lock actuator access aperture 30A is closed to hide the operative lock actuator 18 from view in the interior region 301 to the aperture-opening opened position shown in FIG. 8 to reveal and expose the operative lock actuator 18 so that it can be manipulated by the knowing person to lock or unlock door lock 12. Once lock actuator access aperture 30A is opened, a knowing person may reach through aperture 30A to activate the operative lock actuator 18 to change door lock 12 from the locked mode to the unlocked mode.

In illustrative embodiments, doorknob cover 30 is made of a relatively rigid plastics material and includes companion first and second shells 310 and 320 as suggested in FIG. 6. Shells 310, 320 are configured to mate with one another to form an interior knob-receiving region 301 as suggested in FIGS. 5-7. First shell 310 is formed to include a first pad-receiver aperture 310A opening into interior knob-receiving region 301 and second shell 320 is formed to include an opposing second pad-receiver aperture 320A opening into interior knob-receiving region 301 as suggested, for example, in FIG. 6.

Any suitable means may be used to couple first shell 310 to second shell 320 to form doorknob cover 30. In illustrative embodiments, as suggested in FIG. 6, a top flange 310TF coupled to first shell 310 can be inserted into and retained in a top socket 320TS coupled to second shell 320 and a top flange 320TF coupled to second shell 320 can be inserted into and retained in a top socket 310TS coupled to first shell 310. An upper flange 310UF coupled to first shell 310 can be inserted into and retained in a first upper flange-receiving socket 320US coupled to second shell 320 and a second upper flange 320UF coupled to second shall 320 can be inserted into and retained in a second upper flange-receiving socket 310US coupled to first shell 310. A first lower flange 310LF coupled to first shell 310 can be inserted into and retained in a first lower flange-receiving socket 320LS coupled to second shell 320 and a second lower flange 320LF coupled to second shell 320 can be inserted into and retained in a second lower flange-receiving socket 310LS coupled to first shell 310.

Each force-transmission pad 331, 332 is round and has a convex exterior surface and a concave interior surface as suggested in FIG. 6. A perimeter edge of first force-transmission pad 331 is sized to mate with a first pad-support rim 310R bordering the first pad-receiver aperture 310A. A perimeter edge of second force-transmission pad 332 is sized to mate with a second pad-support rim 320R bordering the second pad-receiver aperture 320A. In illustrative embodiments, pad 331 is made of a flexible TPE material that is overmolded onto first shell 310 and pad 332 is also made of a flexible TPE material that is overmolded onto second shell 320.

The movable button support 31 of actuator access-control shield 20 includes a frame 31F and a frame tether 31T as shown, for example, in FIG. 6. Frame 31F is sized to mate with an upwardly facing frame-support rim 30R defined cooperatively by first and second shells 310, 320. Frame tether 31T has an upper end coupled to frame 31F and an opposite lower end 31TL adapted to be coupled to first shell 310 to limit movement of frame 31F relative to first shell 310 of doorknob cover 30 when, for example, actuator access-control shield 20 is separated from doorknob cover 30 and moved from the aperture-closing position shown in FIG. 7 to the aperture-opening position shown in FIG. 8. In illustrative embodiments, the lower end 31TL of frame tether 31T is a snap-fit bulb that can be pushed through a bulb-receiving aperture 30RA formed in the upwardly facing frame-support rim 30R associated with first shell 310 to link frame tether 31T to doorknob cover 30.

Figure 3:
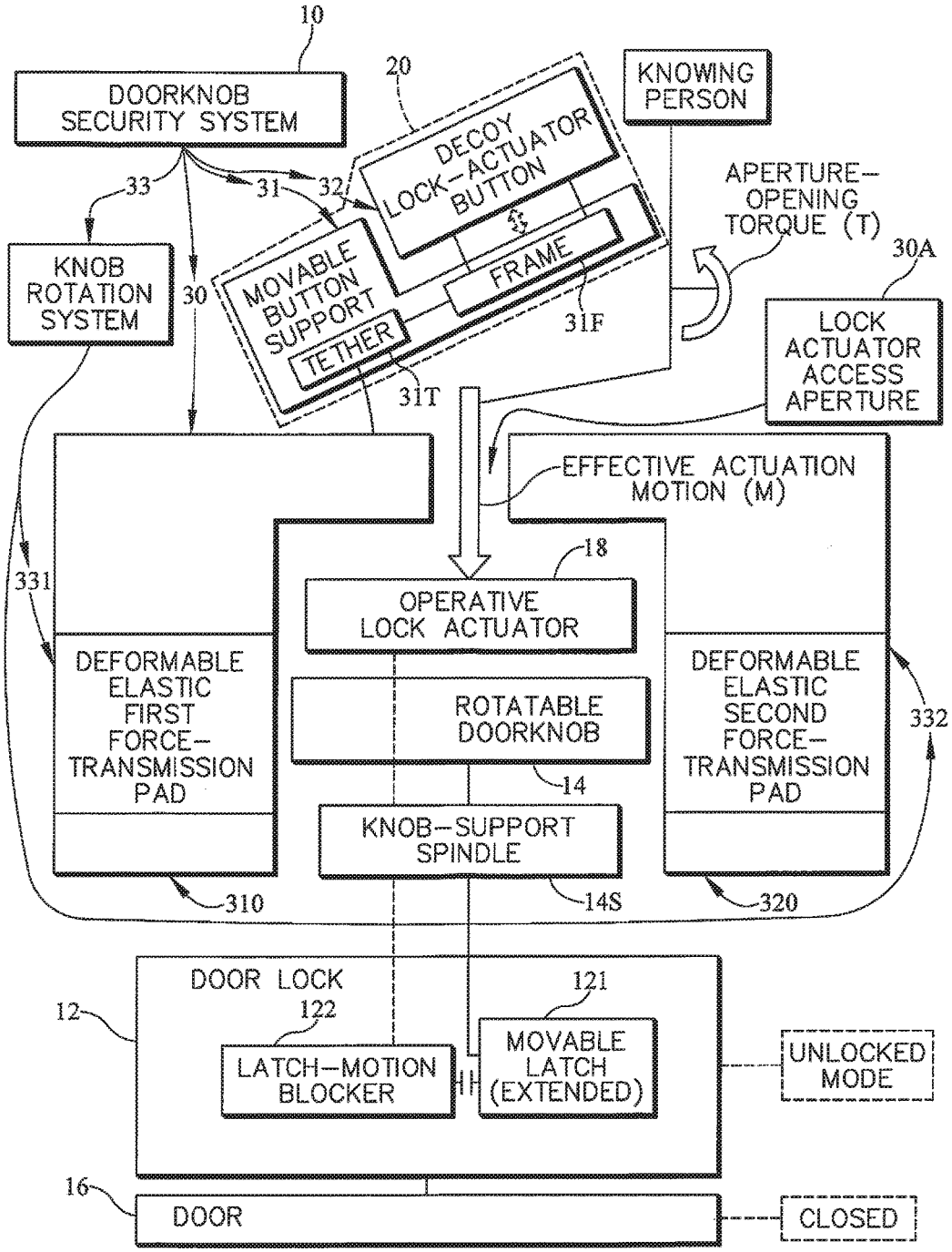
FIG. 3 is a view similar to FIG. 1 and FIG. 2 showing that a knowing person has: (1) moved the movable button support away from the underlying doorknob cover to unblock a lock actuator access aperture formed in the doorknob cover and expose the operative lock actuator that is located in an interior region of the doorknob cover and (2) applied on effective actuation motion (e.g., force or torque) to the operative lock actuator so that the latch-motion blocker is disengaged from the movable latch to unlock the door lock and free the door to be moved from the closed position suggested in FIG. 3 to the opened position shown in FIG. 5.
Figure 4:
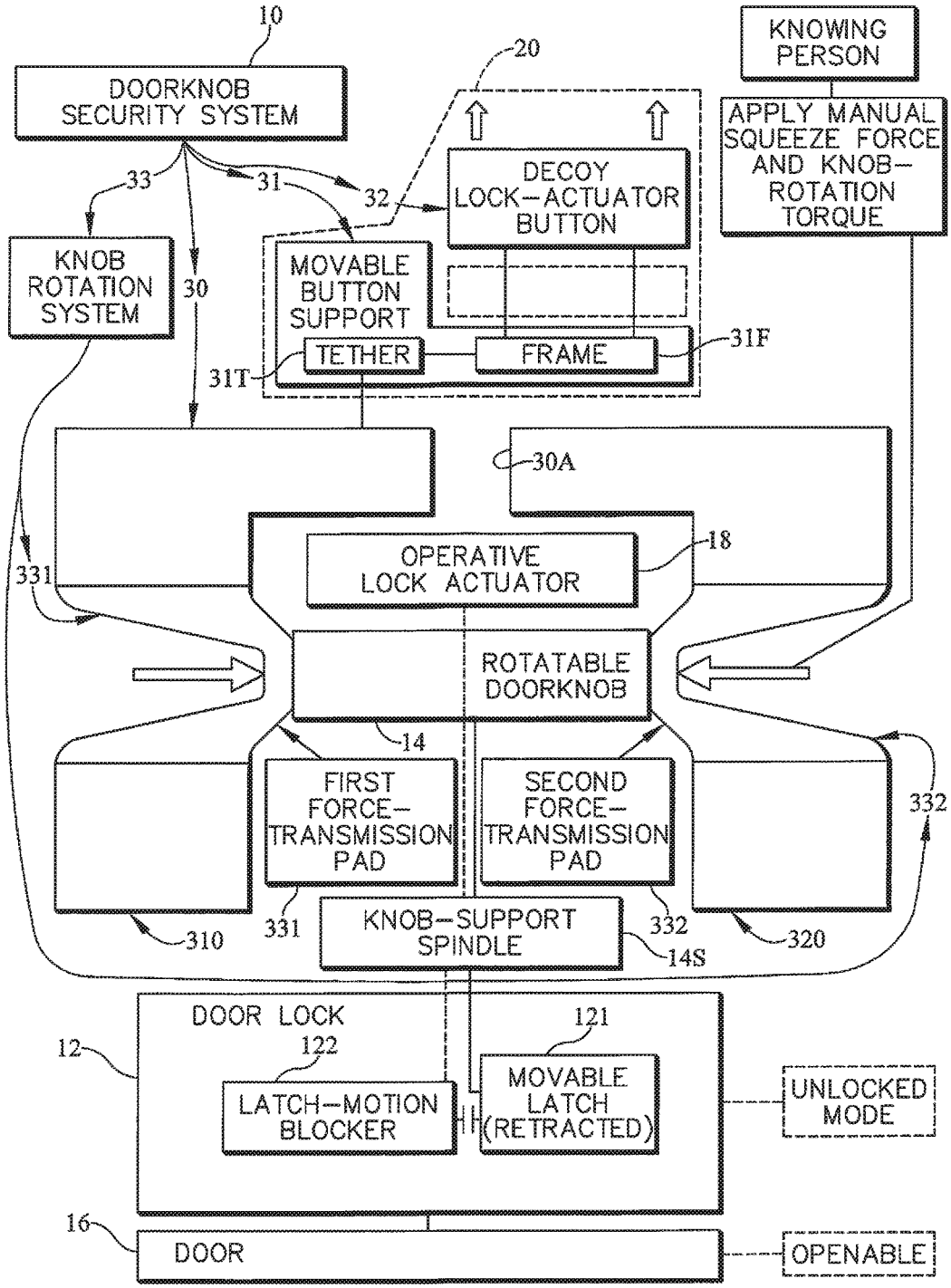
FIG. 4 is a view similar to FIGS. 1-3 showing that a knowing person has applied a squeezing force to the opposing deformable elastic first and second force-transmission pads sufficient to deform those pads to allow that person to grip exterior portions of the rotatable doorknob covered by those pads so that such person can then apply a torque to rotate the rotatable doorknob about its rotation axis to cause the movable latch to be retracted into the door to disengage a companion door frame so that the door is openable and therefore free to be moved from the closed position to an opened position by that person.

The non-operative movable DECOY lock-actuator button 32 is mounted in a visible position on frame 31F of actuator access-control shield 20 as suggested in FIGS. 5-8 for movement relative to frame 31F between a normal projected position shown diagrammatically in FIGS. 1, 2, and 4 and illustratively in FIGS. 5-8 and a temporary depressed position shown diagrammatically in FIG. 3. In illustrative embodiments, DECOY lock-actuator button 32, frame 31F, and tether 31T cooperate to form a monolithic component. It is within the scope of the present disclosure to reduce the thickness of DECOY lock-actuator button 32 as compared to frame 31F to allow button 32 to be fixed and moved relative to frame 31F in response to application of a downward pushing force to button 32.

Doorknob cover 30 is formed to include an upwardly opening support-receiver channel 30C as suggested in FIGS. 6 and 8. The movable button support 31 is arranged to extend downwardly into the upwardly opening support-receiver channel 30C when the movable button support 31 is mated to the deformable cover 30 and the actuator access-control shield 20 is moved to assume the aperture-closing position as suggested in FIG. 7.

The non-operative movable decoy lock-actuator button 32 is made of a pliable elastic material and the movable button support 31 is made of a relatively rigid material in illustrative embodiments of the present disclosure. The non-operative movable decoy lock-actuator button 32 is configured to deform elastically during movement from the normal projected position to the temporary depressed position as suggested in FIGS. 6A and 6B.

Movable button support 31 includes a frame 31F that is configured to mate with top wall 30T of doorknob cover 30 upon movement of actuator access-control shield 20 to assume the aperture-closing position as suggested in FIGS. 7 and 8. Frame 31F includes a platform 31P formed to include a central aperture 31A as suggested in FIG. 6. The non-operative movable decoy lock-actuator button 32 is made of a pliable elastic material and has a supported portion 325 that is mated with the platform 31P and an unsupported portion 32U that is coupled to and surrounded by the supported portion 32S and suspended in an unsupported position aligned with central aperture 31A formed in platform 31P as suggested in FIGS. 6 and 8.

Frame 31F further includes a downwardly extending centering ring 31R coupled to the underside of platform 31P as suggested in FIG. 6. Centering ring 31R is arranged to extend into the lock actuator 30A access aperture when frame 31F is mated to top wall 30T to place central aperture 31A of platform 31P in communication with the lock actuator access aperture 30A.

Frame 31F further includes a button-carrier base 31B that is arranged to lie adjacent to the non-operative movable decoy lock-actuator button 32 and to surround and mate with a perimeter edge of platform 31P as suggested in FIGS. 5-8. The movable button support 31 further includes a tether 31T that is coupled at one end to top wall and at an opposite end to button-carrier base 31B to limit movement of frame 31F relative to doorknob cover 30 when frame 31F is unmated from top wall 30T to open the lock actuator access aperture 30A to expose the operative lock actuator 22 as suggested in FIG. 8.

Button-carrier base 31B includes a platform-support shelf 31BS formed to include a ring-receiving aperture 31BA and an endless rim arranged to surround and mate with a perimeter edge of the platform-support shelf 31BS as suggested in FIG. 6. An underside of the platform 31P is mated with a topside of the platform-support shelf 31BS as suggested in FIG. 6. The non-operative movable decoy lock-actuator button 32 is coupled to the platform 31P as suggested in FIG. 6. The endless rim 31BR is arranged to surround the non-operative movable decoy lock-actuator button 32 as suggested in FIGS. 6 and 7.

The endless rim 31BR and the tether 31T are made of a first material, the platform 31P is made of a second material, and the non-operative movable decoy lock-actuator button 32 is made of a third material in illustrative embodiments. The endless rim 31BR and the tether 31T cooperate to form a monolithic component in illustrative embodiments.

Frame 31F further includes a downwardly extending centering ring 31R coupled to the underside of the platform 31P as suggested in FIG. 6. Centering ring 31R is arranged to extend into and through the ring-receiving aperture 31BA and into the lock actuator access aperture 30A when the platform-support shelf 31BS is mated to the top wall 30T of the doorknob cover 30 to place the central aperture 31BS of the platform 31P in communication with the lock actuator access aperture 30A.

Doorknob security system 10 includes a doorknob cover 30 that is adapted to be coupled to a doorknob 14 for movement relative to doorknob 14. In illustrative embodiments, the doorknob security system 10 further includes a non-operative movable DECOY lock-actuator button 32 that is mounted in a visible position on doorknob cover 30 for movement relative to doorknob cover 30. A door lock 12 associated with doorknob 14 cannot be unlocked regardless of how many times an unauthorized child or other unknowing child pushes the non-operative movable DECOY lock-actuator button 32 in accordance with the present disclosure.

In illustrative embodiments, doorknob 14 is supported on a knob-support spindle 14S for rotation about an axis 14A to control movement of a movable latch 121 relative to a door 16 from (1) an extended position arranged to project into a latch receptacle 24 formed in a companion door frame 16F so that movement of door 16 relative to the companion door frame 16F is blocked to retain door 16 in a closed position as suggested diagrammatically in FIGS. 1-3 to (2) a retracted position withdrawn from latch receptacle 24 so that door 16 is free to be moved relative to door frame 16 to an opened position shown in FIG. 5. The latch 121 does not move relative to door 16 from the extended position to the retracted position when the movable DECOY lock-actuator button 32 is pushed.

In illustrative embodiments, the movable latch 121 cooperates with a latch-motion blocker 122 to provide a door lock 12 that is associated with door 16 but is not connected to the non-operative movable DECOY lock-actuator button 32. Instead, latch-motion blocker 122 is coupled to an operative lock actuator 18 that is coupled to the rotatable doorknob 14 and is separated from the non-operative movable DECOY lock-actuator button 32. As long as door lock 12 is unlocked, a user can rotate doorknob 14 about an axis of rotation 14A to retract latch 24 to disengage the companion door frame 16F so that door 16 can be opened. However, the operative lock actuator 18 is normally hidden from view in accordance with the present disclosure so the only component that is seen by an observer is a non-operative movable DECOY lock-actuator button 32 that has the appearance of being real but, in fact, is non-functional and cannot be operated to lock or unlock the door lock 12.

Doorknob security system 10 is mounted on a doorknob 14 in accordance with the present disclosure to conceal the operative lock actuator 18 and provide a non-operative visible and movable DECOY look-actuator button 32 that will be seen by children as suggested diagrammatically in FIGS. 1-4 and illustratively in FIGS. 5, 7 and 8. The DECOY lock-actuator button 32 can be moved relative to a companion doorknob cover 30 when pushed to provide the illusion of a functional lock actuator. However, the DECOY lock-actuator button 32 is not connected to a door lock 12 associated with doorknob 14 and therefore cannot be operated to unlock the door lock 12.

In illustrative embodiments, doorknob security system 10 comprises an actuator access-control shield 20 that is mounted on a doorknob cover 30 in accordance with the present disclosure to cover an aperture 30A formed in a top wall 30T of doorknob cover 30 to conceal an operative lock actuator 18 located in an interior region 301 bounded by doorknob cover 30. The actuator access-control shield 20 includes a non-operative movable DECOY lock-actuator button 32 that lies in a prominent position above doorknob cover 30 so that is visible will be seen by children. The DECOY lock-actuator button 32 is mounted for movement on a movable button support 31 that is also included in actuator access-control shield 20 and is normally mounted on doorknob cover 30. Unknowing children can see and push the non-operative movable DECOY lock-actuator button 32 included in actuator access-control shield 20 repeatedly without moving the hidden operative lock actuator 18 that must be moved to unlock the door lock 12. Knowing caregivers can move button support 31 of actuator access-control shield 20 away from doorknob cover 30 to separate the DECOY lock-actuator button 32 from the doorknob cover 30 and open a lock actuator access aperture 30A formed in doorknob cover 30 so as to expose the operative lock actuator 18 that is coupled to doorknob 14. Once exposed, the operative lock actuator 18 can be gripped, touched, or otherwise activated by a person reaching through the now-opened lock actuator access aperture 30A and then moved relative to doorknob 14 to unlock door lock 12 as suggested in FIG. 3.

In illustrative embodiments, doorknob security system 10 includes a doorknob cover 30, a movable button support 31, and a DECOY lock-actuator button 32. Doorknob cover is arranged to cover a portion of doorknob 14 to hide the operative lock actuator 18 that is coupled to doorknob 14 so that it cannot be seen by young unknowing children. The DECOY lock-actuator button 32 is mounted on the movable button support 31 to provide an actuator access-control shield 20 that is arranged normally to close a lock actuator access aperture 30A formed in a top wall 30T of doorknob cover 30. The DECOY lock-actuator button 32 is arranged to lie normally in an unconcealed visible location for movement relative to doorknob cover 30.

A young child attempting to play with or unlock the door lock 12 will see only the visible non-operative movable DECOY lock-actuator button 32 that is carried on the movable button support 31 that is coupled to the doorknob cover 30 that covers the doorknob 14. That young child will try to push the DECOY lock-actuator button 32 to try to unlock door lock 12 as suggested in FIG. 2. However movement of the visible DECOY lock-actuator button 32 relative to doorknob cover 30 by an unknowing child or other person does not cause the concealed operative lock actuator 18 to move to unlock door lock 12 so that door lock 12 remains locked and door 16 is retained in its closed position as suggested in FIG. 2.

The invention claimed is:

1. An access-control system for a door lock, the system comprising an operative lock actuator associated with the door lock, the operative lock actuator having a locked mode and an unlocked mode and configured to be operated to change the door lock from the locked mode to the unlocked mode, the operative lock actuator being coupled to a rotatable doorknob that can be locked by the door lock in the locked mode to block rotation of the rotatable doorknob, and a doorknob security system including a doorknob cover coupled to the rotatable doorknob for movement relative to the rotatable doorknob, and the door knob security system including a non-operative movable decoy lock-actuator button supported on an exterior facing portion of the doorknob cover in a visible position adjacent to the doorknob cover, the decoy lock-actuator button configured for movement from a normal projected position to a temporary depressed position in response to application of an external force to the non-operative movable decoy lock-actuator button, such that the decoy lock-actuator button is movable from the normal projected position to the temporary depressed position without activating the operative lock actuator to change the door lock from the locked mode to the unlocked mode.

2. The system of claim 1, wherein the doorknob cover is formed to include a lock actuator access aperture that opens into an interior region of the doorknob cover that contains the operative lock actuator and provides a port through which a person may reach to activate the operative lock actuator to change the door lock from the locked mode to the unlocked mode, and wherein the non-operative movable decoy lock-actuator button is arranged to block access to the operative lock actuator when located in the visible position adjacent to the doorknob cover so as to hide the operative lock actuator from view in the interior region of the doorknob cover.

3. An access-control system for a door lock, the system comprising an operative lock actuator associated with the door lock, the operative lock actuator having a locked mode and an unlocked mode and configured to be operated to change the door lock from the locked mode to the unlocked mode, the operative lock actuator being coupled to a rotatable doorknob that can be locked by the door lock in the locked mode to block rotation of the rotatable doorknob, and a doorknob security system including a doorknob cover coupled to the rotatable doorknob for movement relative to the rotatable doorknob and a non-operative movable decoy lock-actuator button supported in a visible position adjacent to the doorknob cover, the decoy lock-actuator button configured for movement from a normal projected position to a temporary depressed position in response to application of an external force to the non-operative movable decoy lock-actuator button without activating the operative lock actuator to change the door lock from the locked mode to the unlocked mode, wherein the doorknob cover is formed to include a lock actuator access aperture that opens into an interior region of the doorknob cover that contains the operative lock actuator and provides a port through which a person may reach to activate the operative lock actuator to change the door lock from the locked mode to the unlocked mode, and wherein the non-operative movable decoy lock-actuator button is arranged to block access to the operative lock actuator when located in the visible position adjacent to the doorknob cover so as to hide the operative lock actuator from view in the interior region of the doorknob cover, further comprising a movable button support coupled to the doorknob cover for movement relative to the doorknob cover and wherein the non-operative movable decoy lock-actuator button is mounted on the movable button support for movement therewith relative to the doorknob cover and is arranged to cooperate with the movable button support to define an actuator access-control shield that can be moved by a knowing person relative to the doorknob cover from an aperture-closing position in which the lock actuator access aperture is closed to hide the operative lock actuator from view to an aperture-opening position in which the lock actuator access aperture is opened to reveal and expose the operative lock actuator so that the operative lock actuator can be manipulated by the knowing person to change the door lock from the locked mode to the unlocked mode.

4. The system of claim 3, wherein the doorknob cover is formed to include an upwardly opening support-receiver channel, the movable button support is arranged to extend downwardly into the upwardly opening support-receiver channel when the movable button support is mated to the deformable cover and the actuator access-control shield is moved to assume the aperture-closing position.

5. The system of claim 3, wherein the non-operative movable decoy lock-actuator button is made of a pliable elastic material, the movable button support is made of a relatively rigid material, and the non-operative movable decoy lock-actuator button is configured to deform elastically during movement from the normal projected position to the temporary depressed position.

6. The system of claim 3, wherein the movable button support includes a frame that is configured to mate with the top wall of the doorknob cover upon movement of the actuator access-control shield to assume the aperture-closing position, the frame includes a platform formed to include a central aperture, and the non-operative movable decoy lock-actuator button is made of a pliable elastic material and has a supported portion that is mated with the platform and an unsupported portion that is coupled to and surrounded by the support portion and suspended in an unsupported position aligned with the central aperture formed in the platform.

7. The system of claim 6, wherein the frame further includes a downwardly extending centering ring coupled to the underside of the platform and arranged to extend into the lock actuator access aperture when the frame is mated to the top wall to place the central aperture of the platform in communication with the lock actuator access aperture.

8. The system of claim 6, wherein the frame further includes a button carrier base that is arranged to lie adjacent to the non-operative movable decoy lock-actuator button and to surround and mate with a perimeter edge of the platform and the movable button support further includes a tether that is coupled at one end to the top wall and at an opposite end to the button-carrier base to limit movement of the frame relative to the doorknob cover when the frame is unmated from the top wall to open the lock actuator access aperture to expose the operative lock actuator.

9. The system of claim 8, wherein the ring includes a platform-support shelf formed to include a ring-receiving aperture and an endless rim arranged to surround and mate with a perimeter edge of the platform-support shelf, an underside of the platform is mated with a topside of the platform-support shelf, the non-operative movable decoy lock-actuator button is coupled to the platform, and the endless rim is arranged to surround the non-operative movable decoy lock-actuator button.

10. The system of claim 9, wherein the endless rim and the tether are made of a first material, the platform is made of a second material, and the non-operative movable decoy lock-actuator button is made of a third material.

11. The system of claim 9, wherein the endless rim and the tether cooperate to form a monolithic component.

12. The system of claim 9, wherein the frame further includes a downwardly extending centering ring coupled to the underside of the platform and arranged to extend into and through the ring-receiving aperture and into the lock actuator access aperture when the platform-support shelf is mated to the top wall of the doorknob cover to place the central aperture of the platform in communication with the lock actuator access aperture.

13. The system of claim 3, wherein the doorknob cover includes a top wall formed to include the lock actuator access aperture and a side wall arranged to extend downwardly from the top wall to surround the operative lock actuator and the movable button support includes a frame that is configured to mate with the top wall of the doorknob cover upon movement of the actuator access-control shield to assume the aperture-closing position and a tether that is coupled to the top wall and the frame to limit movement of the frame of the movable button support relative to the doorknob cover when the frame is unmated form the top wall to open the lock actuator access aperture to expose the operative lock actuator and wherein the non-operative movable decoy lock-actuator button is mounted on the frame to move therewith relative to the doorknob cover and for movement between the normal projected position and the temporary depressed position.

14. The system of claim 13, wherein the doorknob security system further includes a knob rotation system coupled to the side wall of the doorknob cover and made of a deformable elastic material to provide means for transferring a manual squeeze force applied by a user to the deformable elastic material to allow the user to grip exterior portions of the rotatable doorknob so that such user can then apply a torque to rotate the rotatable doorknob about an axis of rotation when the door lock is in the unlocked mode.

15. The system of claim 14, wherein the doorknob cover is made of a relatively rigid material and the knob rotation system comprises opposing deformable elastic first and second force-transmission pads coupled to opposite sides of the doorknob cover.

16. An access-control system for a door lock, the system comprising an operative lock actuator associated with the door lock, the operative lock actuator having a locked mode and an unlocked mode and configured to be operated to change the door lock from the locked mode to the unlocked mode, the operative lock actuator being coupled to a rotatable doorknob that can be locked by the door lock in the locked mode to block rotation of the rotatable doorknob, and a doorknob security system including a doorknob cover coupled to the rotatable doorknob for movement relative to the rotatable doorknob and a non-operative movable decoy lock-actuator button supported in a visible position adjacent to the doorknob cover, the decoy lock-actuator button configured for movement from a normal projected position to a temporary depressed position in response to application of an external force to the non-operative movable decoy lock-actuator button without activating the operative lock actuator to change the door lock from the locked mode to the unlocked mode, wherein the doorknob cover includes a top wall and a side wall arranged to extend downwardly from the top wall and surround the operative lock actuator, the doorknob security system further includes a knob rotation system coupled to the side wall of the doorknob cover to locate the rotatable doorknob therebetween, the side wall of the doorknob cover is made of a relatively rigid material, and the knob rotation system includes a first force-transmission pad made of a deformable elastic material and coupled to a first portion of the side wall of the doorknob cover and a second force-transmission pad made of a deformable elastic material and coupled to a second portion of the side wall of the doorknob cover to locate the rotatable doorknob therebetween.

17. The system of claim 16, wherein the doorknob cover is formed to include a lock actuator access aperture that opens into an interior region of the doorknob cover that contains the operative lock actuator and provides a port through which a person may reach to activate the operative lock actuator to change the door lock from the locked mode to the unlocked mode, and wherein the non-operative movable decoy lock-actuator button is arranged to block access to the operative lock actuator when located in the visible position adjacent to the doorknob cover so as to hide the operative lock actuator from view in the interior region of the doorknob cover.

18. The system of claim 16, wherein each force-transmission pad is round and includes a concave interior surface facing toward the rotatable doorknob and a convex exterior surface facing away from the rotatable doorknob.

19. The system of claim 16, wherein the doorknob cover includes a first shell and a second shell configured to mate with the first shell to form an interior knob-receiving region containing the rotatable doorknob, the first shell is formed to include a first pad-receiver aperture opening into the interior knob-receiving region, the second shell is formed to include an opposing second pad-receiver aperture opening into the interior knob-receiving region, the first force-transmission pad is sized to mate with a first pad-support rim bordering the first pad-receiver aperture, and the second force-transmission pad is sized to mate with a second pad-support rim bordering the second pad-receiver aperture.

20. The system of claim 19, wherein the first and second shells cooperate to form a side wall of the doorknob cover, the first and second pad-receiver apertures are formed in the side wall, the first and second shells also cooperate to form a top wall coupled to an upper portion of the side wall, and the top wall is formed to include a lock actuator access aperture that opens into the interior knob-receiving region of the doorknob cover and provides a part through which a person may reach to activate the operative lock actuator to change the door lock from the locked mode to the unlocked mode.

21. The system of claim 20, further comprising a movable button support coupled to the doorknob cover for movement relative to the doorknob cover and wherein the non-operative movable decoy lock-actuator button is mounted on the movable button support for movement therewith relative to the doorknob cover and is arranged to cooperate with the movable button support to define an actuator access-control shield that can be moved by a knowing person relative to the doorknob cover from an aperture-closing position in which the lock actuator access aperture is closed to hide the operative lock actuator from view to an aperture-opening position in which the lock actuator access aperture is opened to reveal and expose the operative lock actuator so that the operative lock actuator can be manipulated by the knowing person to change the door lock from the locked mode to the unlocked mode.

* * * * *